US006209718B1

(12) United States Patent
Mollstam et al.

(10) Patent No.: US 6,209,718 B1
(45) Date of Patent: Apr. 3, 2001

(54) TWO-COMPARTMENT PACKAGE

(76) Inventors: Bo Mollstam, 6213 Angus Dr., Suite D, Raleigh, NC (US) 27613; Ivan A. Casas, 6213 Angus Dr., Suite D, Raleigh, NC (US) 27613

( * ) Notice: Subject to any disclaimer, the term of this patent is extended or adjusted under 35 U.S.C. 154(b) by 0 days.

(21) Appl. No.: 09/598,792

(22) Filed: Jun. 21, 2000

Related U.S. Application Data

(62) Division of application No. 08/949,465, filed on Oct. 14, 1997, now Pat. No. 6,105,760.

(51) Int. Cl.[7] ..... B65D 25/08
(52) U.S. Cl. ..... 206/222; 229/103.1
(58) Field of Search ..... 206/219, 222; 229/103.1; 220/705, 710; 221/81

(56) References Cited

U.S. PATENT DOCUMENTS 3,326,363 * 6/1967 Bennett et al. ..... 206/219
3,779,372 * 12/1973 De Lloret ..... 220/705
4,074,827 * 2/1978 Labe, III .
4,785,931 * 11/1988 Weir et al. ..... 206/222
4,874,618 * 10/1989 Seaborne et al. .
5,035,320 * 7/1991 Pione ..... 206/222
5,290,574 3/1994 Jamieson et al. .
5,370,222 * 12/1994 Steigerwald et al. ..... 206/222
5,419,429 * 5/1995 Zimmerman et al. ..... 206/222

* cited by examiner

*Primary Examiner*—David T. Fidei
(74) *Attorney, Agent, or Firm*—Lynn E. Barber

(57) ABSTRACT

A two-part container in which a first compartment for a first component and having an upper and a lower layer is mounted either within or outside a second compartment, for a second component, at the location of a port on the second compartment. Cutting means are provided for cutting both the upper and lower layer and through the port, to release the first component into the second compartment.

14 Claims, 4 Drawing Sheets

TWO-COMPARTMENT PACKAGE

CROSS-REFERENCE TO RELATED APPLICATIONS

This is a divisional application of Ser. No. 08/949,465, filed Oct. 14, 1997. U.S. Pat. No. 6,105,760.

BACKGROUND OF THE INVENTION

1. Field of the Invention

This invention relates to packages, and in particular, pertains to packages having two compartments to keep two components separate until use.

2. Description of the Related Art

Many different types of packages have been designed to enable product components to be kept separate until use and, in some cases, to allow one component to remain sterile until use of the product. In one type of two-compartment package, a stopper or other means is placed in the hole between the two compartments. For example, the two-compartment container of Halm (U.S. Pat. No. 5,417,321) comprises a one-piece container having two compartments assembled one upon another interlinked by a stoppered opening.

Other two-compartment packages utilize a perforating unit to allow the two previously separated components to mix. See, for example, the patents of Goncalves (U.S. Pat. No. 5,170,888 which has a glass defining a first compartment, which is provided with a neck upon which is mounted a bottle defining a second compartment, with a membrane between the two compartments, which is perforated when a perforating unit is displaced relative to the glass, and U.S. Pat. No. 4,757,916 which has two units separated by a cover perforatable as a result of the manipulation of a mixing perforator.

The two-part container of Wiegner (U.S. Pat. No. 4,103,772) has a frangible partition of coated aluminum foil dividing the compartments and a piercing member mounted on a resilient portion transversely directed toward the partition. In the patent of White (U.S. Pat. No. 4,637,934) rigid penetrating means are used to penetrate a compartment closing diaphragm to allow nursing liquid to flow from the compartment to a communicating, attached nipple.

Two compartment packages have also been previously developed which have an opening device attached to the top of the package and are provided with a screw cap and a cylinder jacket shaped supporting ring. The cylinder jacket shaped supporting ring is attached to the top of the package by means of a fixing flange externally surrounding the opening disc, is provided on its inner surface with a raised thread and surrounds the external thread of the screw cap formed from plastics material. A cutter is integrally molded onto the free edge of the screw cap, and is provided with a front cutting edge which passes at an angle through the free edge.

For such products as two-part epoxy glues, two compartments are needed to keep the products from reacting, as in the patent of Wilkinson et al. (U.S. Pat. No. 4,786,279).

The dispenser of Renault (U.S. Pat. No. 5,564,600) has two compartments separated by a sealing member sealed against a seat, so that movement of one of the containers relative to the other causes the sealing member to move away from the seat and form an annular passage between the sealing member and the seat.

There remains a need to have two-compartment packages which keep a first component separate from a liquid component until use, so that the first component does not become wetted until just before use, that keep at least one of the components sterile until just before use, and in which the two components may be easily nixed just before use. For example, there is a need for such containers for the separate packaging of dried microbial cultures which are to be added to a food, liquid nutrition, medicine, or beverage product just before consumption, for the separate packaging of carbonation tablets from a liquid until just before consumption, and for separate packaging of vitamins or other unstable components before addition to a beverage, liquid nutrition, medicine or beverage before consumption.

It is therefore an object of the invention to provide a two-compartment container that keeps a first component, which may be moisture sensitive, from a second component, preferably a liquid, until a selected time before use.

Other objects and advantages will be more fully apparent from the following disclosure and appended claims.

SUMMARY OF THE INVENTION

The invention herein is a two-part container in which a first compartment for a first component which has an upper and a lower layer. The first compartment is mounted either within or outside a second compartment, for a second component, at the location of a port on the second compartment. Cutting means are provided for cutting both the upper and lower layer and through the port, to release the first component into the second compartment Other objects and features of the inventions will be more fully apparent from the following disclosure and appended claims.

DETAILED DESCRIPTION OF THE INVENTION AND PREFERRED EMBODIMENTS THEREOF

The present invention provides a two-compartment container primarily designed for addition of a moisture-sensitive first component, located in a first compartment, to a liquid located in a second compartment, just prior to consumption of the liquid. In each embodiment herein, both the first component and the liquid are entirely separate from each other from the time of filling of the two compartments and assembly of the package, until the first compartment is manually punctured or cut as provided in the particular embodiment. During assembly of each embodiment, the first component is packaged in a separate container prior to assembly of the two-compartment container. The separate container for the first component, when assembled together with the second compartment, becomes the first compartment of the container. The second compartment has at least a portion of its top which is cuttable with a cutter, as described below.

In a first embodiment herein, the invention is an improvement in a cardboard, bottle, liquid enteral nutritional bag, or other beverage container 10A, for example, for milk, juice, water and other liquid products, that has a port 12 that is puncturable by a sturdy plastic straw 14 as is known in the art. As added by the invention herein, there is a separate packet forming a first compartment 16 for a separate first component, that is positioned immediately inside the container 10A beneath the port 12 during manufacture of the container 10A.

Figure 1:
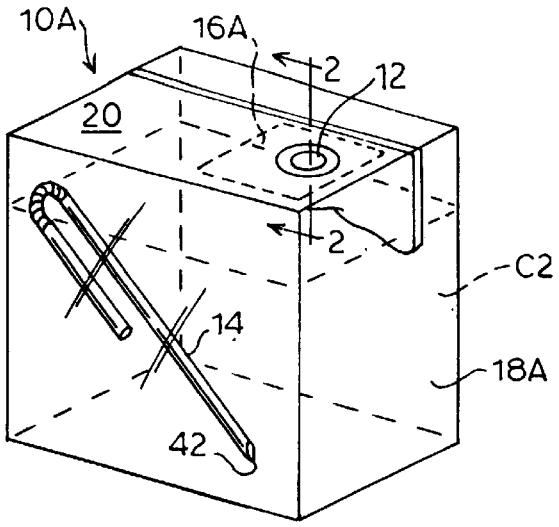
FIG. 1 is a perspective view of a second compartment that may be utilized with the invention herein.

As shown in FIG. 1, the second compartment 18A, which is of a size to hold a selected second component C2, and which forms the bulk of the container 10A in the first embodiment, has a top 20 with the port 12 located toward one end of the top 20. The port 12 is preferably similar to those known in the art and is formed by a hole 22 in the cardboard layer forming the top, beneath which is a thin, cuttable foil layer 24.

First compartment 16A is positioned beneath the foil layer 24 immediately inside the second compartment from the port 12. As shown in more detail in FIG. 2, the first compartment 16A comprises an upper layer 26, a lower layer 28, and a cavity 30 between the upper layer 26 and lower layer 28 for holding the first component C. The first compartment 16A is preferably made of foil, and most preferably of foil having a plastic layer on one surface such as a polyethylene laminated aluminum foil, for example, Catalog No. PETP12 of Danisco (Allborg, Denmark). The foil is preferably formed into a long tube 32, as shown in FIG. 3, and a long seal 34 is formed along the long edge by means known in the art. For example, for plastic-coated foil, the application of heat along the long edges seals the edges together to form the tube 32. One end of the tube 32, designated the first end 36 of the tube is sealed as shown in FIG. 3, and the selected first component C is added in a measured amount to the still open end of the tube so that the first component goes into the first end. When the measured amount has been added to the tube at the first end 36, a sealing means, such as a heat sealer is used to seal off the first end from the remainder of the tube, forming a sealed packet 38. The filling and sealing process is repeated to form a long tube of sealed packets each of which packets contains the measured amount of the first component. It is important that the width of the sealed area 40 between packets be sufficient so that the tube can later be cut along the center of the sealed area 40 without releasing the contents of the packet on either side of the seal, and so that the packets remain sealed after being severed from the tube. Prior to severing of the packets from the tube, the tube may be rolled or otherwise packed for storage and/or shipment to the point of assembly of the container 10A.

Figure 2:
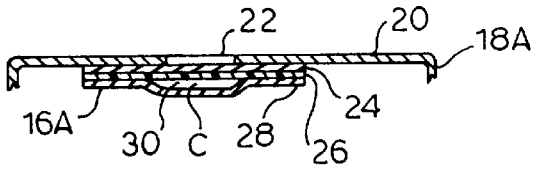
FIG. 2 is a cut-away view of the top of a second compartment according to the first embodiment of the invention showing an internal first compartment.
Figure 3:
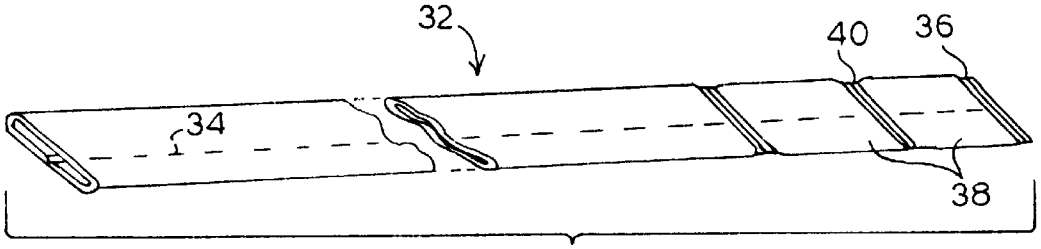
FIG. 3 is a perspective view of a partly finished tube that may be used to form the first compartment of the invention.

At the point of assembly, as the second compartment 18A is being assembled, the tube 32 of sealed packets 38 feeds into the assembly process so that the packets are severed one at a time from the tube, beginning at one end of the tube, along the seal area holding them to the tube, and one packet 38 is positioned beneath the thin, puncturable foil layer 24, and then sealed in place as shown in FIG. 2. Again, the means of sealing may be by glue, heat sealing or any other means known in the art.

During use of this embodiment of the invention, a user takes a straw 14 or other puncturing drinking instrument, which is preferably provided by the manufacturer and sharply pushes the pointed, puncturing end of the straw 42 through the foil layer 24, and then continues the pressure until the straw has cut through both layers 26, 28 of the first compartment 10. The cutting of the lower layer of the packet causes the first component C to be released from the first compartment 10 into the liquid packaged in the second compartment 18A. The user can gently shake the container 10A to enhance mixing; however, the natural movement created by lowering the straw into the container 10A and drinking through the straw generally is sufficient for the mixing desired.

Figure 4:
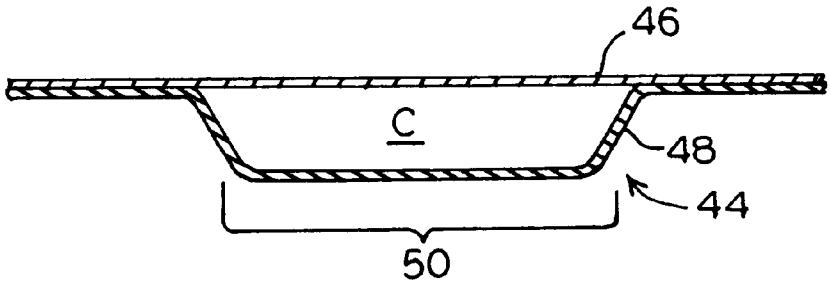
FIG. 4 is a cross-sectional view of a blister-pack first compartment.
Figure 5:
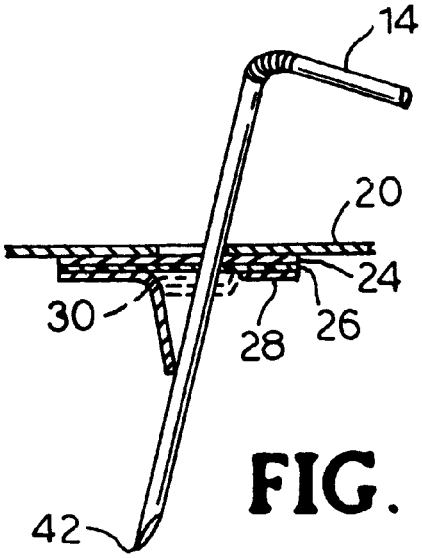
FIG. 5 is a cut-away view of the top of a second compartment of the first invention having a blister-pack first compartment that has been cut open by a straw. The dashed lines show the location of the unopened blister-pack.

An alternative first compartment 16A is a blister-pack 44, as shown in FIGS. 4–5. Blister packs typically have a flat surface sheet 46 sealed to a second sheet 48 around the edges of a molded pocket 50. For use in the first embodiment of the invention, the blister-packs are preferably made of the plastic-coated foil, and a single pocket 50 in a second sheet 48, in which pocket the first component is sealed, is sealed below the foil layer 24. Most preferably, the second sheet 48 is easily releasable from the flat surface sheet around about ¾ of the concave area, so that downward pressure causes the second sheet to form a flap that is pushed downward away from the port, but is still held to the inside of the top of the package as shown in FIG. 5. Thus, puncturing of the foil layer 24 by the cutter, which in this embodiment is preferably straw 14, punctures the flat surface sheet 46 and then either punctures, or pushes against, pocket 50. Methods of forming blister-packs, including blister-packs where one of the layers is easily releasable from part of the other layer, are well-known in the art.

In a second embodiment of the invention herein, the first compartment 16B is positioned outside the second compartment 18B of the container 10B. The second embodiment utilizes a previously developed screw cap/cutting arrangement which is described in more detail below.

Figure 6:
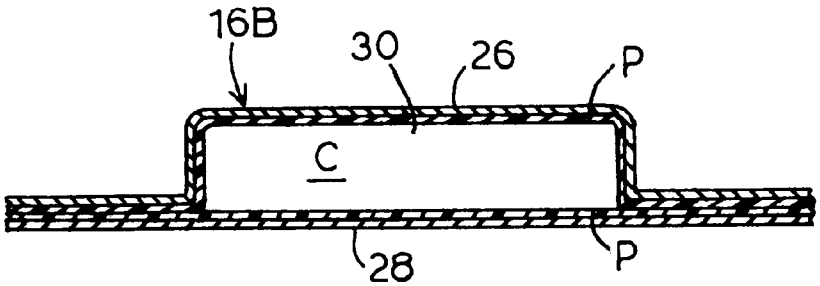
FIG. 6 is a cross-sectional view of a preferred first compartment for use in the second embodiment of the invention.

First compartment 16B is positioned between the screw cap/cutting arrangement 60 and the second compartment 18B of the container 10B in this embodiment. First compartment 16B is positioned immediately outside the second compartment at the desired location of opening of the container 10B, preferably over a port 12, by means known in the art, such as glue or heat sealing. As shown in more detail in FIG. 6, the first compartment 16B comprises upper layer 26, lower layer 28, and cavity 30 between the upper layer 26 and lower layer 28 for holding the first component C. In this embodiment, which is particularly useful for more bulky first components, upper layer 26, is preferably bowed upward as shown in FIG. 67 so that cavity 30 is sufficiently large to hold a larger first component. First compartment 16B is preferably made of foil, and most preferably of foil having a plastic layer on one surface as discussed above with respect to the first embodiment, which is preferably made by the blister-pack method discussed above, except that second sheet 48 is on top and the flat surface sheet 46 faces downward With the use of the plug 86 described below there is no need to have the two layers of the blister-pack be easily releasable from each other; however, both the plug and release features may be combined.

Plastic supporting ring 62, which is circularly symmetrical with respect to the central axis of the screw cap/cutting arrangement 60 at the lower edge thereof for welding, during assembly of the completed container 10B, by means of a fixing flange 64, to the top of the second compartment 18B of the package. The supporting ring 62 is composed of seating part 66 and spacing ring 68 which are both separated from one another by a predetermined breakage line 70 running parallel to the top of the package. The spacing ring 68 is provided on its upper part with a radially outwardly extending supporting flange 72 and a tear flap 74 molded onto the ring 68 so that it is graspable by a user of the container 10B and its contents. The inner surface of seating part 66 of the supporting ring 62 has a raised thread 76 which extends completely around the ring 62.

The prior screw cap that is used in this embodiment of the invention comprises a radially larger rotating part 78 and a hollow threaded portion 80 radially smaller than the rotating part 78. The threaded projection 80 is configured as a hollow cylinder 82 with a noticeably smaller radius than the rotating part 78. An external thread 84 of the hollow threaded portion 80 fits during rotary engagement into the annular ring formed by the raised thread 76, and the external periphery of the rotating part 78 fits into the supporting flange 72 and comes to rest on this flat horizontal ring.

There is a cutter 88 located on the free edge 90 of the screw cap, which has a straight front cutting edge 92. The front end 94 of the front cutting edge 92 is preferably configured in the shape of a point 96 (FIGS. 7–8) for cutting the material of which the top 20 of the second compartment is made, after the upper and lower layers are cut.

In the second embodiment of the invention herein, there is provided a novel central plug 86, attached to the lower surface of the radially larger rotating part 78 and extending downward in the hollow threaded portion 80 so that when the screw cap is turned to lower the cutter, the plug 86 moves downward toward the second compartment 18B on which the screw cap is mounted. Because plug 86 is attached, for example, by glue, to the central part of the upper layer 26 of the first compartment 16B, when the cutter cuts through first compartment 16B, the central portion of the upper layer 26 (which may be the pocket 50 of the second sheet 48) is held on the plug 86 and does not drop into the liquid second component C2.

Figure 7:
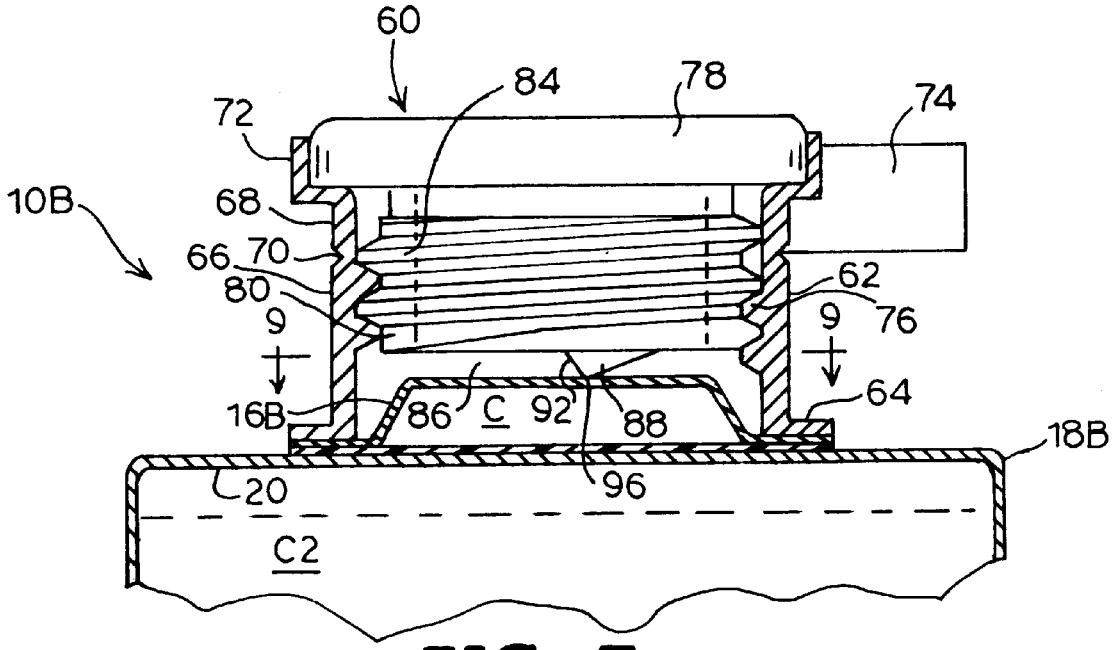
FIG. 7 is a partial fragmentary lateral view and partial longitudinal section of the screw-cap cutting arrangement and plug of the second embodiment of the invention herein.
Figure 8:
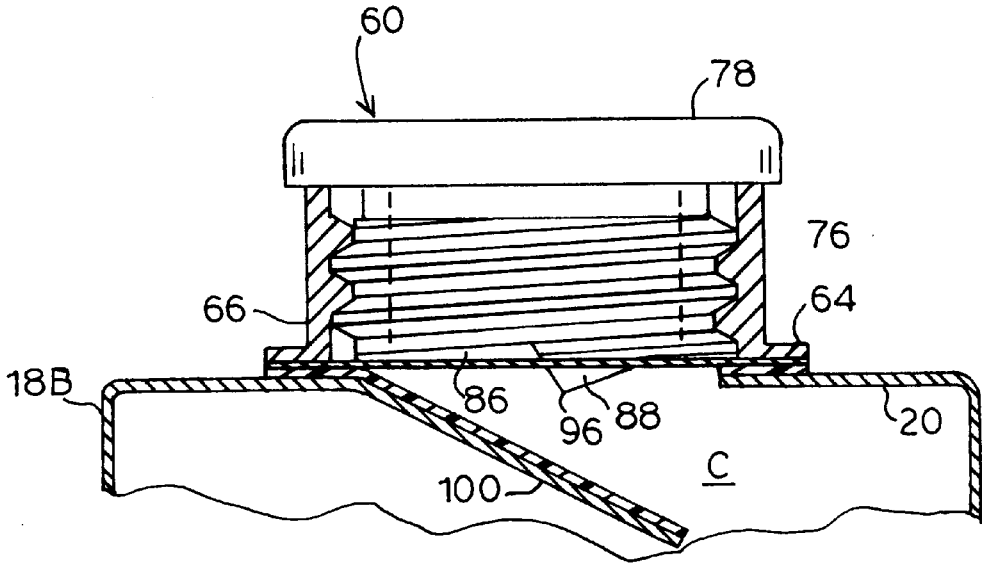
FIG. 8 is a view like that in FIG. 7, wherein after removal of the spacing ring, the screw cap is screwed down far enough in the direction of the inside of the package so that not only is the cut made along a periphery over approximately 270° in the opening disc, but also the opening disc is folded down in a flap-like manner.
Figure 9:
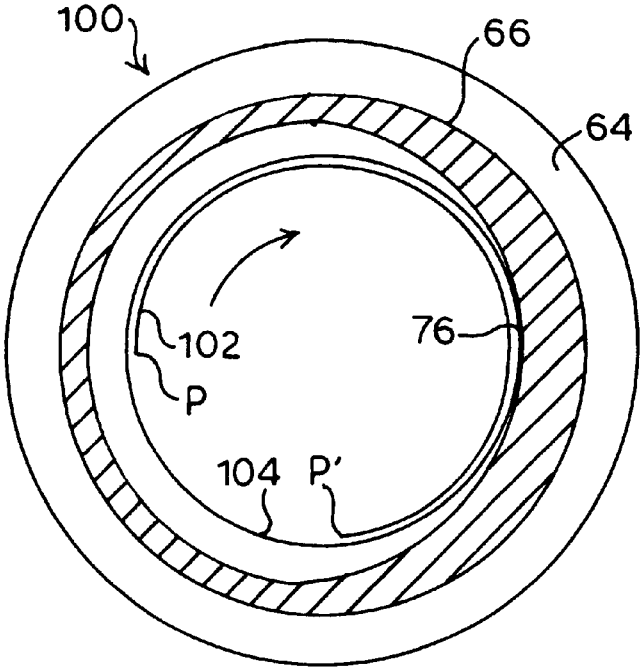
FIG. 9 is a plan view of the cut, but not folded down or bent up top, together with the seating part.

The screw cap/cutting arrangement is positioned immediately over a single first compartment 16B as shown in FIG. 7 so that when the cap is screwed downward its full extent, as described in detail below, the contents of the first compartment 16B are released into the second compartment 18B. The severing of the top 20 of the package is done at the outer periphery of an opening circular disc 100 so that there is a cut along line 102 over an angle of 270° (about ¾ of the way around the disc. FIG. 9 shows the cut but not bent up or folded away opening disc 100 shown with seating part 66 surrounding the opening disc 100, with the fixing flange 64. The innermost surface of the raised thread 76 is shown as a circle 104 and on this circle 104 lies the cutter which is not visible in FIG. 9, as the screw cap is not screwed in in the representation shown in that figure.

FIG. 7 shows the opening device before the initial opening, when the front end 94 or point of the cutter 88 has not yet engaged with the top of the package. This is achieved by the axial length of the hollow cylindrical threaded projection 80 being set at the height of the supporting ring 62. Strong pressing in of the front end 94 of the cutter 88 is not possible at this stage because the radially larger rotating part 78 is held in the supporting flange 72 of the supporting ring 62. An analogous view of the opening device and a first compartment modified for use on a bottle-neck is shown in FIG. 10.

To enable a first component to be added to a second component, the user grips the flap 74 and tears the spacing ring 68 along the circular predetermined breakage line 70. This allows the screw cap to be further rotated clockwise so that the threaded projection 80 with the cutter 88 is moved downward along a line perpendicular to the top surface of the package towards the top of the package. The point or front end of the cutter 88 first penetrates and cuts a complete circle in both the upper and lower layers 26, 28, and then penetrates the top of the package, for example at the point designated P in FIG. 9. When the screw cap is rotated further in a clockwise direction, the front cutting edge 92 runs along the circular periphery of the opening disc 100 along the three-quarter circle as far as the point designated P'. Along this circular path between points P and P', the front cutting edge 92 penetrates deeper and deeper into the top 20, so that the uppermost, furthest back portion of front cutting edge 92 stops cutting at point P'. If the cap is rotated further, the front cutting edge 92 does not perform any further cutting as it has dipped inside the package below the plane of the top. Rather, the adjacent thread as shown in fragmentary manner in FIG. 9 ensures that the opening disc 100 is bent and at least partially folded away into an acute angle.

Figure 10:
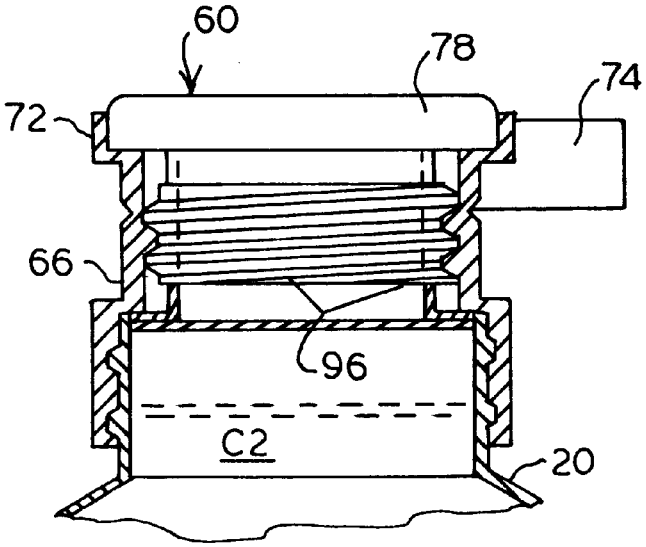
FIG. 10 is a cross-sectional view of the second embodiment utilized with a second compartment that has a bottleneck.

As the screw cap is rotated, the plug 86, to which the severed central area of the upper layer 26 is attached, presses on the partially severed lower layer 28 which is attached to the opening circular disc 100, pushing them into the second container 10B a shown in FIG. 10. This allows the first component C to drop out of the first compartment 16B when the plug 86 is withdrawn by unscrewing the cap, through the hole formed by the partially removed, bent back opening disc 100, and into the second compartment 18B.

The screw cap can then be unscrewed to open the container 10B for access to the contents thereof.

The first embodiment of the invention is particularly useful for adding unstable and/or sterile components to a beverage, liquid enteral nutrition or medicine, for example, adding vitamins or beneficial gastrointestinal microorganisms, such as *Lactobacillus reuteri*, to fruit juice, milk, water, medicine, and the like. The second embodiment may also be used for the same purposes, particularly where the volume of liquid in the second compartment is greater than for a single serving. Additional uses include for addition of tablets that form carbonation upon the addition to liquid for creation of carbonated beverages just prior to drinking or for medicinal use.

While the invention has been described with reference to specific embodiments, it will be appreciated that numerous variations, modifications, and embodiments are possible, and accordingly, all such variations, modifications, and embodiments are to be regarded as being within the spirit and scope of the invention.

What is claimed is:

1. A two-compartment container, for addition of a first component to a liquid second component, comprising:

(a) a first compartment containing a first component, said first compartment having an upper layer above the first component and a lower layer below the first component, said first compartment being made of a cuttable material;

(b) a straw-shaped cutter having a pointed end for cutting the upper layer and the lower layer; and (c) a second compartment containing the second component, and having a top that is cuttable with the cutter;

wherein said first compartment is attached to the second compartment so that cutting of the top with the cutter also cuts a portion of the upper layer and a portion of the lower layer, releasing the first component into the second compartment for addition to the second component, wherein the first component and the second component are completely separated from each other until the cutter is used to manually cut both the upper layer and the lower layer.

2. The container according to claim 1, wherein there is a port on the top for cutting with the cutter, and wherein the first compartment is located within the second compartment immediately inside the second compartment from the port.

3. The container according to claim 1, wherein the first compartment is located outside the second compartment on the top of the second compartment.

4. A method of forming a two-part container, comprising:

(a) providing a first compartment containing a first component, said first compartment having an upper layer above the first component and a lower layer below the first component, said first compartment being made of a cuttable material;

(b) providing a straw-shaped cutter having a pointed end for cutting the upper layer and the lower layer;

(c) providing a second compartment larger than said first compartment and containing a second component, and having a top that is cuttable with said cutter; and (d) attaching the first compartment to the second compartment so that when said top is cut with said cutter so that the second component can be removed from the port, the upper layer and the lower layer are also cut with the cutter, wherein the first component and the second component are completely separated from each other until the cutter is used to manually cut both the upper layer and the lower layer.

5. The method according to claim 6, wherein there is a port on the top for cutting with the cutter, and wherein the first compartment is located within the second compartment immediately inside the second compartment from the port.

6. The method according to claim 4 wherein the first compartment is located outside the second compartment on the top of the second compartment.

7. The container according to claim 1, wherein the first component is selected from the group consisting of vitamins, tablets and beneficial gastrointestinal microorganisms.

8. The container according to claim 7, wherein the first component comprises *Lactobacillus reuteri.*

9. The container according to claim 1, wherein the second component is selected from the group consisting of fruit juice, milk, water and liquid medicine.

10. The container according to claim 9, wherein the first component comprises *Lactobacillus reuteri.*

11. The method according to claim 4, wherein the first component is selected from the group consisting of vitamins, tablets and beneficial gastrointestinal microorganisms.

12. The method according to claim 11, wherein the first component comprises *Lactobacillus reuteri.*

13. The method according to claim 4, wherein the second component is selected from the group consisting of fruit juice, milk, water and liquid medicine.

14. The method according to claim 13, wherein the first component comprises *Lactobacillus reuteri.*

* * * * *